US006290466B1

(12) United States Patent
Ravenhall et al.

(10) Patent No.: US 6,290,466 B1
(45) Date of Patent: Sep. 18, 2001

(54) COMPOSITE BLADE ROOT ATTACHMENT

(75) Inventors: John A. Ravenhall, Hamilton; Thomas C. Mesing, Loveland, both of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/399,197

(22) Filed: Sep. 17, 1999

(51) Int. Cl.[7] ..... F01D 5/14

(52) U.S. Cl. ..... 416/229 A; 416/219 R; 416/220 R

(58) Field of Search ..... 416/219 R, 220 R, 416/221, 224, 229 A, 230, 241 A, 248

(56) References Cited

U.S. PATENT DOCUMENTS 3,640,640 * 2/1972 Palfreyman et al. ..... 416/220 R 5,160,243 * 11/1992 Herzner et al. ..... 416/220 R

* cited by examiner

*Primary Examiner*—Edward K. Look
*Assistant Examiner*—James M McAleenan
(74) *Attorney, Agent, or Firm*—Andrew C. Hess; Nathan D. Herkamp

(57) ABSTRACT

A preferred embodiment of said present invention is a gas turbine engine blade root shim for use between a composite blade root and a wall of a slot for receiving the root in a rotor of the engine. An exemplary embodiment of the shim includes a longitudinally extending base having distal first and second transversely spaced apart ends, first and second longitudinally extending legs acutely angled inwardly towards the base from the first and second ends, and first and second low coefficient of friction coatings on first and second outwardly facing surfaces of the first and second legs, respectively. Among coatings suitable for use in the present invention are polytetrafluoroethylene powder dispersed in a resin binder and other coatings which include polytetrafluoroethylene.

13 Claims, 3 Drawing Sheets

COMPOSITE BLADE ROOT ATTACHMENT

BACKGROUND OF THE INVENTION

1. Field of the Invention

This invention relates to root attachment of composite blades to a rotor of gas turbine engines and, more particularly, to a low friction blade root to slot wall interface for composite blade composite roots.

2. Discussion of the Background Art

Gas turbine engine composite fan blades have dovetails or roots carried by a slot in a metal disk or drum rotor. During operation, under high compressive loads and relative movement between the root and a wall of the slot (often referred to as a disk post), wear and fretting erosion have been observed, particularly in the blade roots carried by the rotor. Composite blades made of stacked or layed-up plies of a reinforced polymeric material; for example an epoxy matrix reinforced with a fiber structure such graphite, glass, boron, etc, as is well known in the art. Examples of such blades are described in U.S. Pat. Nos. 3,752,600; 4,040,770; and 5,292,231. Generally, in such known structures, it has been common practice to dispose metal outserts or metal shells between the blade root and the dovetail slot of the carrying member, in the splayed design conveniently used in such assemblies. The contact between the metal slot of the carrying member and the metal outsert or shell at the juncture between the blade and the slot has resulted in wear and fretting erosion at that interface.

In order to overcome such fretting and subsequent erosion, a composite blade root and a rotor assembly was developed as described in U.S. Pat. No. 5,373,377, entitled "Assembly Of A Composite Blade Root And A Rotor", which is assigned to the General Electric Company, the same assignee as the assignee of this patent and which is hereby incorporated herein by reference. U.S. Pat. No. 5,573,377 discloses an assembly of a plurality of composite blades including blade roots carried by blade root receiving slots in the rotor wherein the slot has a slot wall with a radially outward portion which, when assembled, diverges from a spaced apart juxtaposed blade root pressure face radially outer surface in an amount which is a function of a predetermined amount of centrifugal loading on the blade during operation of the assembly, to allow at least a portion of the radially outer surface of the root pressure face to be in contact with the slot wall radially outward surface during operation. Root outer pads have a plurality of substantially non-metallic, composite plies, rather than metal, bonded with the airfoil structural plies extending into the blade root. A low friction wear coat to help reduce friction induced stresses in the blade root is applied to a root outer pressure face. The wear coat can be applied to and cured on the pressure face and examples of such a coating material include self lubricating films or cloths such as a fabric weave of polytetrafluoroethylene (PTFE) fibers such as Teflon material fibers, glass type fibers, and organic aramid fibers such as Nomex material fibers. Also, a spray of Teflon material or other forms of PTFE material can be used. The low friction coating helps prevent the blades from becoming locked in the rotor slot during deceleration of the rotor during operation. An additional benefit from use of the low friction coating in this combination is the ability of the blade root to slip at a predictable loading condition and provide damping for the blade during resonant crossings and potential blade instabilities, due to the relative motion between the blade base and the rotor slot wall.

A shim disposed between the low friction coat and a slot provides a desired hardness and surface finish to obtain still more improved performance from the low friction wear coat material. The shim is particularly important where the slot wall is a titanium alloy in which desired wear properties are not always achievable. The shim extends the life of the wear coat and prevents wear from occurring to the slot wall is positioned between the wear coat and the slot wall and is both replaceable and removable from the rotor dovetail. The shim can be made of a single material such as steel, titanium or a titanium alloy or it can be a single material having a coating such as copper or a copper alloy on one side.

Fan rotors are balanced in new engines over the engine rotational speed operating range up to redline speeds. Difficulties arise because there is relative fan blade radial and circumferential moment weight changes caused by inconsistent fan blade dovetail seating in the slot associated with break-in of the wear strip. During engine acceptance testing the ran rotor has to be rebalanced after several engine break-in cycles, i.e. ten cycles in one exemplary case, before the proper fan blade dovetail seating is achieved. It is highly desirable to eliminate the need for rebalancing the fan rotor after these break-in cycles.

SUMMARY OF THE INVENTION

The present invention provides a gas turbine engine blade root shim for use between a composite blade root and a wall of a slot for receiving the root in a rotor of the engine. An exemplary embodiment of the shim includes a longitudinally extending base having distal first and second transversely spaced apart ends, first and second longitudinally extending legs acutely angled inwardly towards the base from the first and second ends, and first and second low coefficient of friction coatings on first and second outwardly facing surfaces of the first and second legs, respectively. Among coatings suitable for use in the present invention are polytetrafluoroethylene powder dispersed in a resin binder and other coatings which include polytetrafluoroethylene.

One embodiment of the present invention is a rotor assembly having a plurality of composite blades carried by a rotor as a support member, each of the composite blades including a plurality of bonded composite plies comprising an airfoil, and a blade root shaped to be carried by the rotor. The blade root includes a composite root outer pressure pad disposed on the root and carried by the rotor and having a plurality of non-metallic composite plies bonded together and with the blade root. A plurality of the blade root receiving slots are circumferentially disposed around the rotor in a disk or a drum. Each of the slot walls has at least a portion which is shaped to receive a blade root and includes a radially inward portion and a radially outward portion shaped to receive and carry at least a portion of a root outer pressure face of the composite root pressure pad. A root outer pressure face on the composite root outer pressure pad has a radially inner surface extending from a root end and a radially outer surface extending from a junction with the inner surface toward the blade airfoil. The inner surface is pressed towards and carried by the slot wall. The root pressure face radially outer surface and the slot wall radially outward portion, when assembled, are in diverging spaced apart juxtaposition beginning at the junction between the root pressure face inner and outer surfaces and generally diverging radially outwardly therefrom in a diverging amount, which is a function of a predetermined amount of centrifugal loading on the blade during operation of the rotor assembly. This is to allow at least a portion of the radially outer surface of the root outer pressure face to be pressed towards the slot wall radially outward surface during operation. A low friction wear coat is disposed on the root outer pressure face between the pressure face and the slot wall and the shim carried by the slot wall is disposed between the low friction wear coat and the slot wall. The shim having the low coefficient of friction coating on an outwardly facing surface of the shim in contact with the low friction wear coat.

The low coefficient of friction coatings on the legs of the shim allow the blade roots to properly seat in the slots of the rotor obviating the need to rebalance the rotor during engine assembly or reassembly and testing.

BRIEF DESCRIPTION OF THE DRAWINGS

The novel features believed characteristic of the present invention are set forth and differentiated in the claims. The invention, together with further objects and advantages thereof, is more particularly described in conjunction with the accompanying drawings in which:

DETAILED DESCRIPTION

Figure 1:
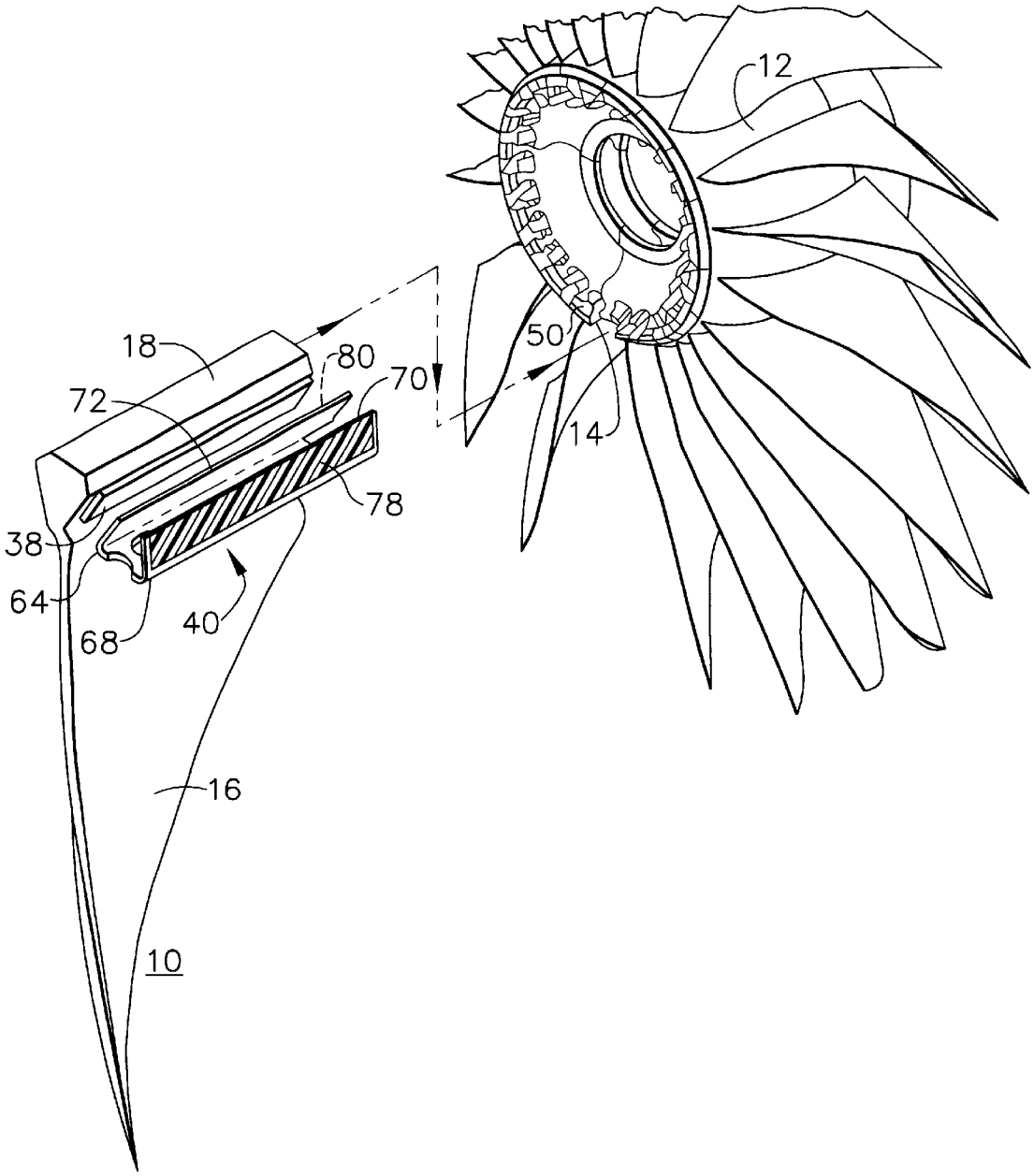
FIG. 1 is an exploded view illustration of a composite fan blade and shim of the present invention as assembled in a dovetail slot of a gas turbine engine rotor.

FIG. 1 is an exploded view illustration of a composite fan blade 10 of the present invention carried by a supporting member, for example, a disk or drum of a gas turbine engine rotor 12 through a dovetail slot 14. The blade 10, representative of a plurality of circumferentially disposed blades carded by a rotor in circumferentially disposed blade receiving dovetail slots 14, has a composite airfoil 16 and a splayed dovetail root 18 through which the blade is carried by the rotor 12.

Figure 2:
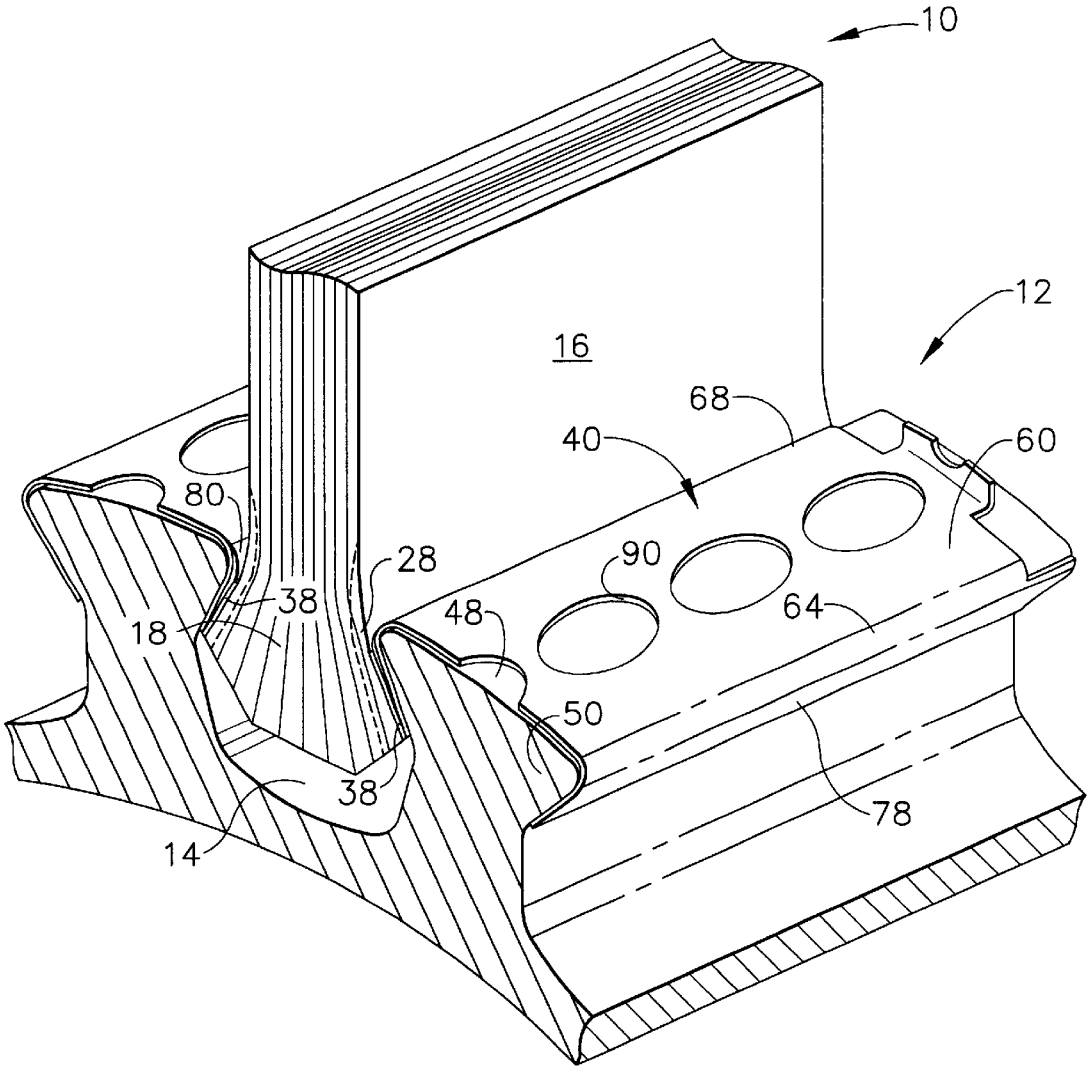
FIG. 2 is a fragmentary perspective partially sectional view illustration of the composite blade and shim in the assembly of FIG. 1.
Figure 3:
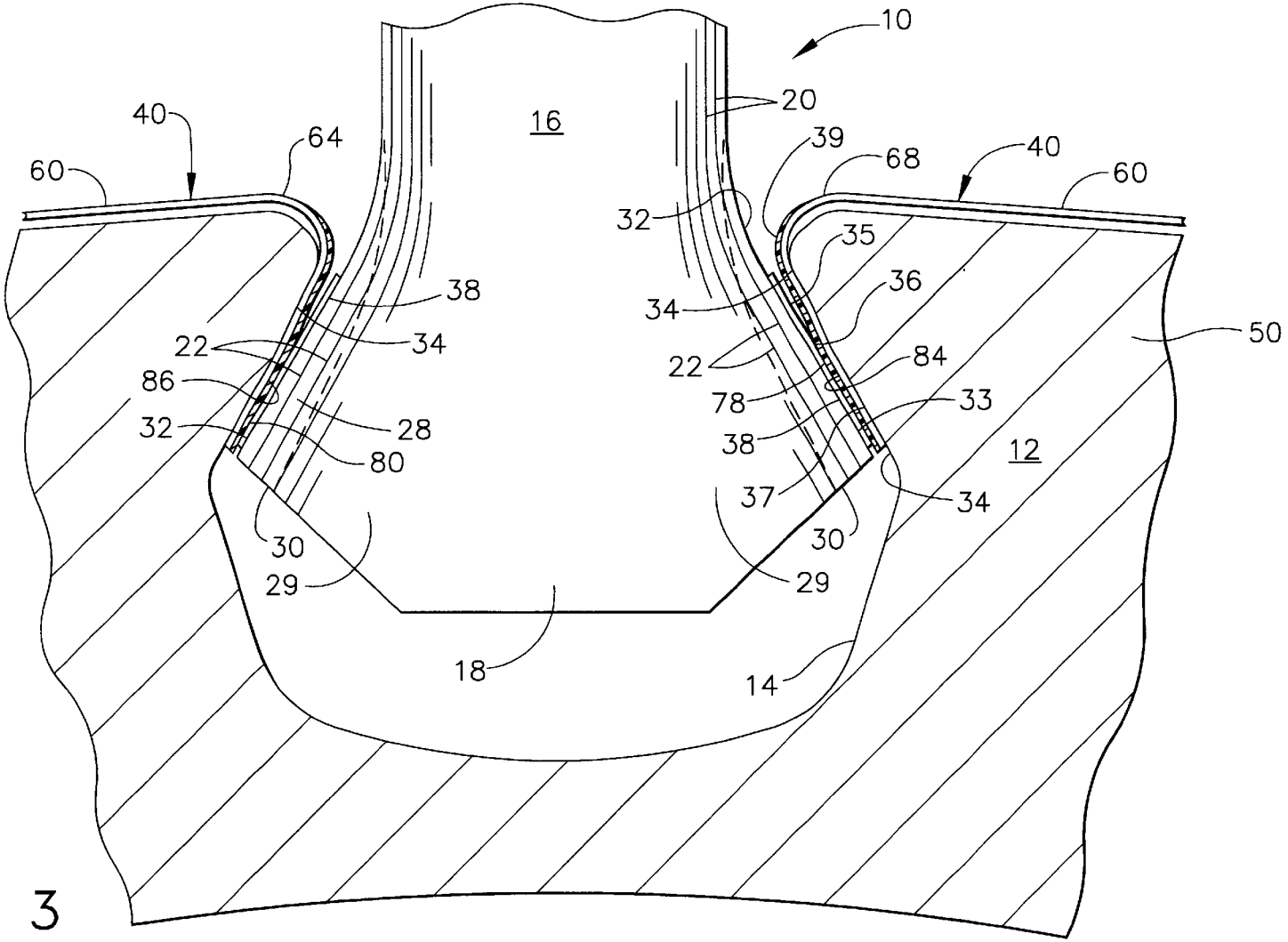
FIG. 3 is a further enlarged diagrammatic fragmentary view illustration of the assembly of the blade root and shim in the dovetail slot.

Referring further to FIGS. 2 and 3, the blade 10 includes a plurality of layed-up composite plies including a first plurality of structural and load carrying airfoil plies 20 in the airfoil and a second plurality of root plies 22 in the root 18. The root plies 22 are bonded together, such as by a process well known in the art, to form a pair of root outer pressure pads 28.

The composite blade 10 includes two of the non-metallic root outer pressure pads 28, one at each lobe 29 of the dovetail root 18, which are shaped to be carried by slot walls 34 of the dovetail slot 14. Pressure pad 28 includes a root end 30 extending along a radially inner portion of the root toward a root outer pressure face 32. Each one of the slot walls 34 cooperates with the outer pressure face 32 to carry the blade root 18 when assembled. In the exemplary embodiment of the present invention, the blade root 18 including the outer pads 28 are designed as a function of stresses due to centrifugal forces expected to be experienced during engine operation.

The root outer pressure face 32 of the pressure pad 28 comprises a radially inner surface 33, which cooperates in contact with dovetail slot wall radially inward portion 37 when assembled. Face 32 also includes a radially outer surface 35, extending radially outwardly from a junction 36 between the pressure face inner and outer surfaces. The outer surface 35 is in spaced apart juxtaposition with dovetail slot wall radially outward portion 39, generally diverging radially outwardly from junction 36, for example, at a small angle such as in the range of about 1.degree.–2.degree., beginning at the junction 36 of inner and outer surfaces 33 and 35. This feature is sometimes referred to as "crowning" with respect to the assembly of the blade and rotor and enables induced crush stresses, due to centrifugal force loading during operation of the rotor, to be dispersed in both the root pressure pad and the blade structural or airfoil plies along the full length of the pressure face 32 during operation. The centrifugal force load tends to move the inner surface 33 and the outer surface 35 towards one another.

A low friction wear coat 38 on the outer pressure face 32 of the blade root 18 is used to help reduce friction induced stresses in the blade root. Such a wear coat is typically applied to and cured on the pressure face 32. Examples of such a coating material include self lubricating films or cloths such as a fabric weave of polytetrafluoroethylene (PTFE) fibers, organic aramid fibers, or glass type fibers. See U.S. Pat. No. 5,573,377 for examples and some commercially available fabrics. Also, a spray of Teflon material or other forms of PTFE material can be used. The combination of the low friction coating with the above described "crowning" helps prevent the blades from becoming locked in the rotor slot during deceleration of the rotor during operation.

The shim 40 is disposed between the low friction wear coat 38 and the slot wall 34 provides a desired hardness and surface finish to obtain still more improved performance from the low friction wear coat material, extends the life of the wear coat, and helps prevent wear from occurring to the slot wall. This feature is particularly important where the slot wall is a titanium alloy in which desired wear properties are not always achievable. The shim 40 is both replaceable and removable and fits over a top of what is commonly referred to as a post 50 which makes up a portion of the slot wall 34. In the case of a rotor disk the post is referred to as a disk post.

The shim can be made of a single material such as steel, titanium or a titanium alloy or it can be a single material having a coating such as copper or a copper alloy on one side. In another form, the shim can be a bimetallic material such as a strip or sheet of an iron base alloy, for example, steel secured with a strip or sheet of a softer material, for example, copper or a copper alloy. In the example of a bimetallic shim having a relatively hard iron base alloy on one side and the relatively soft copper or copper alloy on the other side, the soft side is disposed opposite the slot wall to help prevent any relative motion between the slot wall and the shim, avoiding fretting or wear of the slot wall. According to the present invention, the shim in the forms described above includes material properties and surface finish on the side that opposes the low friction coat that improves performance of such a coating. The other side of the shim that opposes the slot wall and the rotor can be of a different material, which is sacrificial, so that the shim does not cause wear or fretting of the slot pressure faces. Use of a relatively soft material on the side of the shim that opposes such slot wall helps to prevent relative motion between the wall and the shim, preventing fretting or wear of the slot wall. Also, it forces substantially all motion to take place between the low friction wear coat and the shim, where the coefficient of friction is known, and the optimization of the blade root stresses can be fully utilized. Stress and weight relief holes 90 are disposed through the base 60 to help relieve stresses that might shorten life of the shim 40.

The shim includes a longitudinally extending base 60 having distal first and second transversely spaced apart ends 64 and 68, respectively, first and second longitudinally extending legs 70 and 72, respectively, that are acutely angled inwardly towards the base from the first and second ends and first and second low coefficient of friction coatings 78 and 80, respectively, on first and second outwardly facing surfaces 84 and 86, respectively, of the first and second legs respectively. Among coatings suitable for use in the present invention are polytetrafluoroethylene powder dispersed in a resin binder and other coatings which include polytetrafluoroethylene.

The present invention has been described in connection with various embodiments, examples and combinations. However, it will be understood by those skilled in the arts involved that this invention is capable of a variety of modifications, variations and amplification without departing from its scope as defined in the appended claims. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by letters patent of the united states is the invention as defined and differentiated in the following claims.

What is claimed is:

1. A gas turbine engine blade root shim comprising:

a longitudinally extending base having distal first and second transversely spaced apart ends, a first longitudinally extending leg acutely angled inwardly towards said base from said first end, and a first low coefficient of friction coating on a first outwardly facing surface of said first leg.

2. A shim as claimed in claim 1, wherein said coating comprises polytetrafluoroethylene powder dispersed in a resin binder.

3. A shim as claimed in claim 1, wherein said coating includes polytetrafluoroethylene.

4. A shim as claimed in claim 1, further comprising a second longitudinally extending leg acutely angled inwardly towards said base from said second end and a second low coefficient of friction coating on a second outwardly facing surface of said second leg.

5. A shim as claimed in claim 4, wherein said coatings comprise polytetrafluoroethylene powder dispersed in a resin binder.

6. A shim as claimed in claim 4, wherein said coatings include polytetrafluoroethylene.

7. A rotor assembly comprising:

a plurality of composite blades carried by a rotor as a support member, each of said composite blades including a plurality of bonded composite plies comprising an airfoil and a blade root shaped to be carried by said rotor, said blade root having a composite root outer pressure pad disposed on said root and carried by said rotor, said composite root outer pressure pad comprising a plurality of non-metallic composite plies bonded together and with said blade root;

a plurality of circumferentially disposed blade root receiving slots having a slot wall at least a portion of which is shaped to receive a blade root, said slot wall including a radially inward portion and a radially outward portion and shaped to receive and carry at least a portion of a root outer pressure face of said composite root pressure pad;

said blade including a root outer pressure face on said composite root outer pressure pad, said pressure face having a radially inner surface extending from a root end, and a radially outer surface extending from a junction with said inner surface toward said blade airfoil, said inner surface being pressed towards and carried by said slot wall;

said root pressure face radially outer surface and said slot wall radially outward portion, when assembled, being in diverging spaced apart juxtaposition beginning at said junction between said root pressure face inner and outer surfaces and generally diverging radially outwardly therefrom in a diverging amount which is a function of a predetermined amount of centrifugal loading on said blade during operation of said rotor assembly, to allow at least a portion of said radially outer surface of said root outer pressure face to be pressed towards said slot wall radially outward surface during operation;

a low friction wear coat on said root outer pressure face between said pressure face and said slot wall;

a shim carried by the slot wall and disposed between said low friction wear coat and said slot wall, said shim having a low coefficient of friction coating on an outwardly facing surface of said shim in contact with said low friction wear coat.

8. A rotor assembly as claimed in claim 7, wherein said coating comprises polytetrafluoroethylene powder dispersed in a resin binder.

9. A rotor assembly as claimed in claim 8, wherein said coating includes polytetrafluoroethylene.

10. A rotor assembly comprising:

a plurality of composite blades carried by a rotor, each of said composite blades including a plurality of bonded composite plies comprising an airfoil and a blade root shaped to be carried by said rotor;

a plurality of circumferentially disposed blade root receiving slots having a slot wall at least a portion of which is shaped to receive a blade root, said blade including a root outer pressure face facing said slot wall;

a low friction wear coat on said root outer pressure face between said pressure face and said slot wall; and a shim carried by the slot wall and disposed between said low friction wear coat and said slot wall, said shim having a first low coefficient of friction coating on an outwardly facing surface of said shim in direct contact with said low friction wear coat.

11. A rotor assembly as claimed in claim 10 further comprising:

said shim having a longitudinally extending base having distal first and second transversely spaced apart ends, first and second longitudinally extending legs acutely angled inwardly towards said base from said first end and second ends respectively, said first low coefficient of friction coating on a first outwardly facing surface of said first, and a second longitudinally extending leg acutely angled inwardly towards said base from said second end and a second low coefficient of friction coating on a second outwardly facing surface of said second leg.

12. A rotor assembly as claimed in claim 11, wherein said coatings comprise polytetrafluoroethylene powder dispersed in a resin binder.

13. A rotor assembly as claimed in claim 11, wherein said coatings includes polytetrafluoroethylene.

* * * * *